United States Patent [19]

Ottenhues

[11] 4,119,031

[45] Oct. 10, 1978

[54] APPARATUS FOR APPLYING AND WITHDRAWING A PRESSURE CYLINDER ACTING ON THE PLATE CYLINDER IN AN INTAGLIO PRINTING PRESS

[75] Inventor: Ludger Ottenhues, Riesenbeck, Fed. Rep. of Germany

[73] Assignee: Windmoller & Holscher, Lengerich of Westphalia, Fed. Rep. of Germany

[21] Appl. No.: 823,683

[22] Filed: Aug. 11, 1977

[30] Foreign Application Priority Data

Aug. 27, 1976 [DE] Fed. Rep. of Germany ..... 2638750

[51] Int. Cl.[2] ..... B41F 13/40

[52] U.S. Cl. ..... 101/153; 101/247

[58] Field of Search ..... 101/152, 153, 247, 182, 101/184, 185, 179, 181, 180; 100/170

[56] References Cited

U.S. PATENT DOCUMENTS

| | | | |
|---|---|---|---|
| 2,207,785 | 7/1940 | Crafts | 101/153 |
| 2,607,292 | 8/1952 | Harless | 101/153 |
| 3,131,631 | 5/1964 | Haskin, Jr. | 101/152 |
| 3,601,046 | 8/1971 | Motter | 101/247 |

FOREIGN PATENT DOCUMENTS

| | | | |
|---|---|---|---|
| 2,000,885 | 1/1969 | France | 101/247 |

*Primary Examiner*—J. Reed Fisher

*Attorney, Agent, or Firm*—Fleit & Jacobson

[57] ABSTRACT

In an intaglio printing press, apparatus for applying and withdrawing a pressure cylinder to the plate cylinder during replacement of the latter comprises displaceable journals for the pressure cylinder operatively connected to a piston-cylinder unit. To control the withdrawing motion of the pressure cylinder, a pressure medium is fed beneath the piston by way of a pressure regulating valve which is open during printing and which is moved to a closed position by a cam carried along by the piston rod.

2 Claims, 4 Drawing Figures

APPARATUS FOR APPLYING AND WITHDRAWING A PRESSURE CYLINDER ACTING ON THE PLATE CYLINDER IN AN INTAGLIO PRINTING PRESS

The invention relates to an apparatus for applying and withdrawing a pressure cylinder acting on the plate cylinder in an intaglio printing press and for executing a long stroke thereof necessary for effecting a cylinder change, the journals of the pressure cylinder that are displaceable in the frame of the press being connected to a lifting cylinder serving to raise and lower the pressure cylinder and being intercoupled by a synchronising shaft.

In an apparatus of this kind known from DT-AS No. 1 611 303, only one journal of the pressure cylinder is actuated by a lifting cylinder and the motion of this journal is transmitted to the other journal by the synchronising shaft. The known apparatus has the disadvantage that the force exerted by the pressure cylinder on the plate cylinder is larger on the side of the journal driven by the lifting cylinder than it is on the other side and that the pressures between the pressure cylinder and the plate cylinder cannot be selected at will at the ends of the cylinders so as to meet the requirements of the printed impression.

From U.S. Pat. No. 3,131,631 it is known to mount screw-threaded spindles in supporting members which are pivotable about a shaft parallel to the shaft of the pressure cylinder, it being possible for each supporting member to be brought to the applied and withdrawn position by a respective pressure medium piston-cylinder unit. The supporting member lies against abutments in its applied position. With the aid of the known apparatus, although it is possible to apply and withdraw the pressure cylinder, it is not possible to effect a fine adjustment of the force with which the pressure cylinder is pressed onto the plate cylinder. In addition, the force, once it has been determined by way of experiment, cannot be reproduced because the changing frictional forces in the screw-thread of the spindle prevent this from being achieved. Further, the forces with which the pressure cylinder is applied by the pressure medium piston-cylinder units cannot be set separately so that a different force that is often necessary at the ends of the pressure and plate cylinders cannot be selected in accordance with the engraving and the printed impression may turn out to be weaker at one end of the plate cylinder than at the other.

It is therefore an object of the present invention to provide an apparatus for applying and withdrawing a pressure cylinder which acts on the plate cylinder in an intaglio printing press, which apparatus permits the fine setting of different forces across the web to be printed, this setting being reproducible, and which executes the short stroke for the applying and withdrawing motion and also moves the pressure cylinder further away from the plate cylinder when the size is changed, and which during a change in size will automatically be set to the respective cylinder diameter.

This object is fulfilled according to the invention in that for the purpose of controlling the withdrawing motion a pressure medium for raising the lifting pistons is fed beneath same into the lifting cylinders by way of a regulating valve which is moved from the open position during printing to a closed position by the cam face of a cam carried along by the piston rod of the lifting piston, that the lifting pistons can be lifted for a cylinder change by way of a circuit bypassing the regulating valve, and that during printing the pressures of the pressure medium in the lifting cylinders are controllable by way of fine regulating valves. In the apparatus of the invention, the appropriate forces between the pressure cylinder and plate cylinder can be selected according to the engraving of the printed impression by setting the fine regulating valves. By reading the experimentally found pressures, this setting can be readily reproduced at a later date when the printing is repeated.

For withdrawal of the pressure, pressure medium is supplied to the lifting pistons by the regulating valve until the regulating valve has been moved above the cam face to such an extent that it is closed or that it is no longer traversed by pressure medium because a condition of equilibrium has been attained. The lifting stroke during withdrawal can be selected by appropriately shaping the cam face.

Desirably, during displacement of the piston for a cylinder change a piston rod carries along the regulating valve in its closed position. By being carried along, the regulating valve adapts itself to the different lifting strokes required by the respective cylinder diameters so that, after the size has been changed, no adjustment is necessary for setting the height of the regulating valve.

Instead of a regulating valve, it is also possible to provide a pilot valve.

In a further development of the invention, both journals of the pressure cylinder are each connected to a lifting cylinder and at least one journal is provided with a dog and a control cam, the dog moving a fine regulating valve, which controls the application and withdrawal motion for a cylinder change, parallel to the stroke of the pressure cylinder over a path that includes a reversing period, and the control cam switching the fine regulating valve off or on within the reversing period during the application and withdrawal motion, and a pressure medium system co-operating with the lifting cylinders comprises fine regulating valves separately settable for each lifting cylinder and separate pressure gauges for the separate setting of the pressures acting on the lifting cylinders. The control motions of the fine regulating valve take place within the reversing period between the motion of the pressure cylinder and the raising and lowering motion of the fine regulating valve so that the path covered during the withdrawal motion will thereby also always remain constant and need not be specially adjusted after each change in size.

Desirably, the reversing period is achieved in that the fine regulating valve is secured to a slide plate having a groove wider than the dog which engages therein and carries along the slide plate.

An example of the invention will now be described in more detail with reference to the drawing, in which.

Figure 1:
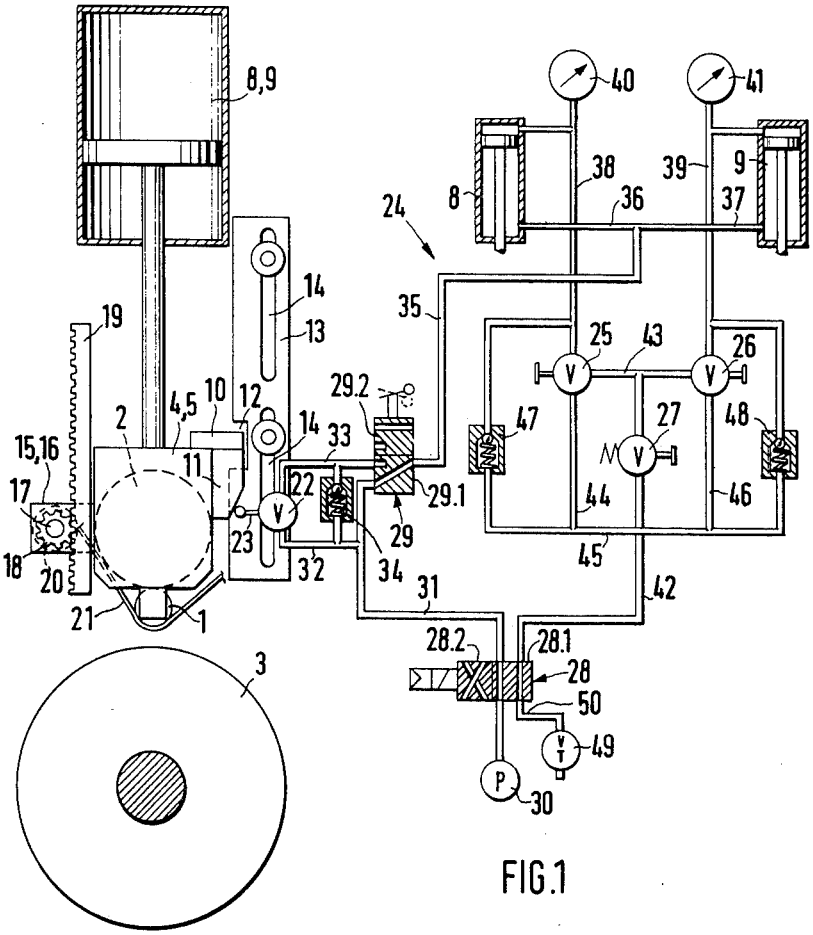
FIG. 1 is a diagrammatic front elevation of an intaglio printing press with a pressure medium regulating system.

A pressure cylinder 1 is disposed between an impression cylinder 2 and a plate cylinder 3 of a printing press. The pressure cylinder 1 and the impression cylinder 2 are mounted at their ends in journals 4, 5 which are displaceable radially to the plate cylinder 3 in guides 6, 7 of the frame of the press. The pressure cylinder 1 has bearings which are separate from those of the impression cylinder 2 but are coupled therewith and independently displaceable and, during the applying motion, is pressed against the impression cylinder 2 by the plate cylinder 3. Each journal 4, 5 is connected to the piston rod of fixed pressure medium cylinders 8, 9. A dog 10 and a control cam 11 are secured to one of the journals 4 or 5. The dog 10 engages in a groove 12 of a slide plate 13 which is not fixed to the frame of the machine but, by overcoming a frictional force, is displaceable in the direction of elongated holes 12 provided in the slide plate 10. The frictional force can for example be achieved by plate springs provided beneath the securing belts. The groove 12 is wider than the dog 10 so that, on actuation of the lifting cylinders 8, 9, the slide plate 13 traverses a distance that is shorter than the difference in the widths of these parts and that will be referred to as a reversing period. Also connected to the journals 4, 5 there are bearings 15, 16 of a synchronising shaft 17, on both ends of which pinions 18 are secured for engaging fixed racks 19. A guide roller 20 is loosely rotatably mounted on the shaft 17 and the web 21 to be printed is passed thereabout. Between the pinions 18 and the racks 19 there is enough play to enable the pressure cylinder 1 and impression cylinder 2 to be slightly inclined to the plate cylinder 3 without interference from the synchronising shaft 17. This oblique position may be necessary if such is required by the impression to be printed. A pilot valve or fine regulating valve 22 is secured on the slide plate 13. Its actuating tappet 23 is actuated by the control cam 11. The pilot valve 22 is designed so that it blocks flow when the actuating tappet 23 is projected. When using a fine regulating valve at this position, the pressure is substantially zero. It is part of a pressure medium regulating system 24 by which the lifting and lowering motion of the lifting cylinders 8, 9 can be controlled. The regulating system 24 further comprises fine regulating valves 25 to 27, a magnetic valve 28 and a manual valve 29. A conduit extends from a source 30 of pressure medium to the magnetic valve 28. From there, conduits 31, 32 lead to the valve 29 and to the pilot valve 22 which is connected by a further conduit 33 to the valve 29. The conduits 32, 33 are bridged by a check valve 34 which blocks forward running. Conduits 35 to 37 lead from the valve 29 to the pressure chambers disposed beneath the pistons of the lifting cylinders 8, 9. The pressure chambers disposed above the pistons are connected by conduits 38, 39, which include a pressure gauge 40, 41, to the fine regulating valves 25, 26 which, when the magnetic valve is switched from its illustrated position 28.1 to its alternative position 28.2, are fed with the pressure medium through conduits 42, 43. By means of the fine regulating valve 27 in the conduit 42 one can set the base value of the pressure of the medium for both lifting cylinders 8, 9 and by means of the fine regulating valves 25, 26 one can set the peak amounts for each lifting cylinder 8, 9 alone. The fine regulating valves 25, 26 are interconnected by conduits 44 to 46 and the conduits 38 and 44 or 39 and 46 are bridged by check valves 47, 48 which block in the illustrated manner.

Figure 2:
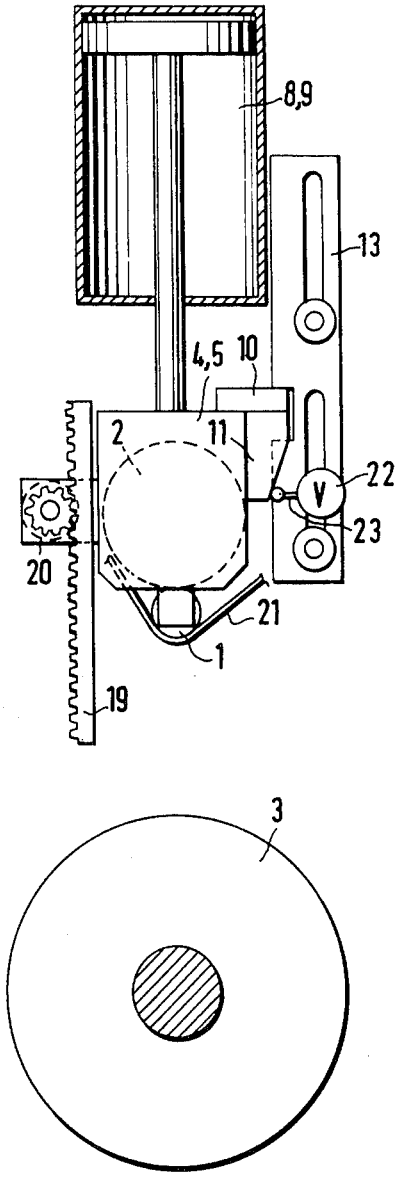
FIGS. 2 and 3 are diagrammatic side elevations of the printing mechanism with different relative positions for the printing cylinders.

In the position of the valves 28, 29 shown in FIG. 1, the pressurised medium is fed from the source 30 of pressure medium through the conduits 31, 35 to 37 to the pressure chambers located beneath the pistons of the lifting cylinders 8, 9. This causes the journals 4, 5 to rise and the dog 10 takes the slide plate 13 with it upwardly against the frictional force set by the securing bolts. In this position of the pressure cylinder 1 shown in FIG. 2, the pressure cylinder 1 and the plate cylinder 3 can be readily replaced.

Figure 3:
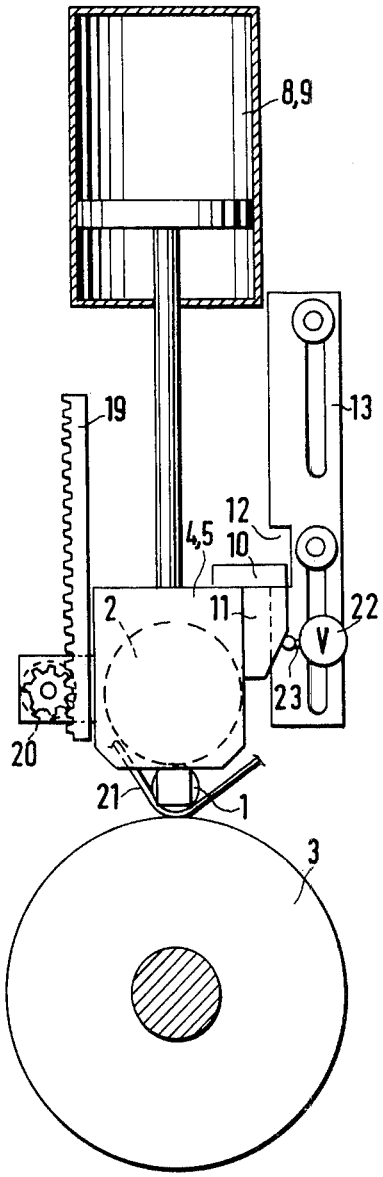
Figure 4:
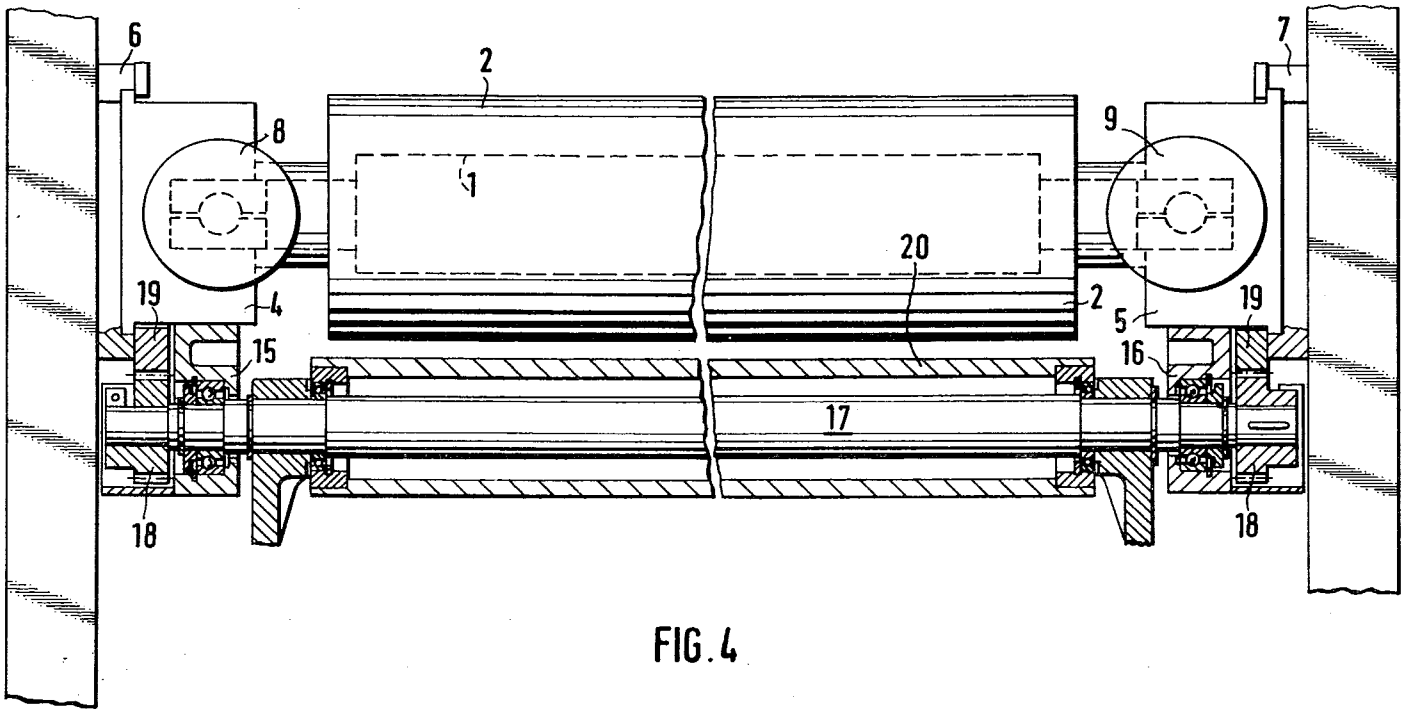
FIG. 4 is a plan view of the impression cylinder.

After reversing the valve 29 to the position 29.2, the pilot valve or fine regulating valve 22 is connected to the conduits 31 and 35. After changing the cylinders, the magnetic valve 28 is brought to the position 28.2 by releasing the 'pressure on' signal at a switch desk (not shown) of the press. After reversing the position of the valve 29 to the position 29.2 and by means of the 'pressure on' signal, the pressure medium flows through the conduits 42, 43, 38, 39 to the pressure chambers disposed above the pistons of the lifting cylinders 8, 9, so that the pressure cylinder moves downwardly until it lies against the plate cylinder 3 as shown in FIG. 3. In this position, the actuating tappet 23 is pressed by the control cam 11 and the pilot valve 22 is opened. This open position is not necessary for the printing operation because the pressure medium can also flow off through the check valve 34 but it is required for the withdrawal motion to be described in more detail hereinafter.

The force exerted by the lifting cylinders 8, 9 onto the plate cylinder 3 acting through the pressure cylinder 1 by way of the impression cylinder 2 can be set as a whole by regulating the fine regulating valve 27 and can be set separately for each lifting cylinder 8, 9 alone by regulating the fine regulating valves 25, 26. Impact of the pressure cylinder 1 on the plate cylinder 3 during downward motion is prevented in that an adjustable throttle 49 is provided in the return conduit 50. This throttle permits the lowering speed to be selected at will.

The pressure withdrawal motion of the pressure cylinder 1 when the press is stopped is actuated by a signal released at the aforementioned switch desk. This brings the magnetic valve 28 to the position 28.1. The pressure medium will now flow through the conduit 32 and the pilot valve or fine regulating valve 22 to the pressure chambers beneath the pistons of the lifting cylinders 8, 9 and the pressure cylinder 1 is raised. However, the control cam 11 is simultaneously lifted, whereby the actuating tappet 23 of the pilot valve or fine regulating valve 22 can be extended until the pilot valve blocks the flow of pressure medium or the fine regulating valve reaches a condition of equilibrium between the weight of the pressure cylinder, its bearings and the pistons of the lifting cylinders 8, 9. The pressure application and withdrawal motion of the pressure cylinder 1 takes place within the reversing period so that the slide plate 13 or the pilot valve or the fine regulating valve 22 remains stationary in the meantime. The elevation of the pressure cylinder 1 above the plate cylinder 3 in the position 'pressure off' can be selected by varying the position of the pilot valve or fine regulating valve 22 on the slide plate 13. The pilot valve or fine regulating valve 22 is fixed in the selected position. When the size is changed, the set 'pressure off' elevation is achieved automatically in that the slide plate is carried along further downwardly in the case of a smaller plate cylinder 3, the distance by which it is carried along being limited in the above-described manner by the pressure cylinder 1 coming to lie against the plate cylinder 3.

I claim:

1. An intaglio printing press having a pressure cylinder (1) acting on a plate cylinder (3), the press being adapted to be connected to a pressure source and having a frame, a journal for each end of the pressure cylinder displaceably mounted in the frame, lifting cylinder means having lifting cylinders (8,9) associated with respective journals (4,5) of the pressure cylinder (1) for raising and lowering the pressure cylinder, synchronizing shaft means for intercoupling the journals, and an apparatus cooperating with said lifting cylinder means for applying and withdrawing the pressure cylinder and for moving the pressure cylinder a predetermined distance to effect a cylinder change, said apparatus comprising:

first regulating valve means for controlling application and withdrawal movement of said pressure cylinder during printing by selectively connecting the pressure source to said lifting cylinders (8,9), said movement including a reversing period;

circuit means bypassing said first regulating valve means for connecting the pressure source to said lifting cylinders for raising the pressure cylinder for a cylinder change;

valve control means associated with one of the journals (4,5) and having a dog (10) and a control cam (11) for controlling said first regulating valve means, said control cam (11) switching said first regulating valve means during the reversing period and closing said first regulating valve means during cylinder change; and second regulating valve means connectable to the pressure source for controlling pressure furnished said lifting cylinders during printing and including fine regulating valves (25,26) separately settable for each lifting cylinder (8,9), pressure sensing means (40,41) for indicating the pressures acting on the lifting cylinders, and regulating valve means (27) for controlling the supply of pressure from the pressure source to said fine regulating valves (25,26).

2. A printing press according to claim 1 wherein said first regulating valve means comprises a fine regulating valve (22) secured to a slide plate (13) having a groove (12) wider than the dog (10) which engages therein and carries along the slide plate (13).

* * * * *